US005340622A

United States Patent [19]

Curitti

[11] Patent Number: 5,340,622

[45] Date of Patent: Aug. 23, 1994

[54] ARTIFICIAL TREE

[76] Inventor: Lenee J. Curitti, 317 Logan St., McMechen, W. Va. 26040

[21] Appl. No.: 913,036

[22] Filed: Jul. 14, 1992

Related U.S. Application Data

[63] Continuation-in-part of Ser. No. 761,628, Sep. 18, 1991, Pat. No. Des. 343,318.

[51] Int. Cl.[5] ..... A41G 1/00

[52] U.S. Cl. ..... 428/18; 428/21

[58] Field of Search ..... 47/66; 52/233; 405/272; 428/18, 19, 20, 17, 21; 156/61; 211/196, 205; D11/118

[56] References Cited

U.S. PATENT DOCUMENTS

| | | | |
|---|---|---|---|
| D. 309,639 | 7/1990 | Knudsen | 428/18 X |
| 2,080,523 | 5/1937 | Williams et al. | 428/18 |
| 2,251,705 | 8/1941 | Gonzalez | 428/18 X |
| 2,251,706 | 8/1941 | Loewy | 428/18 X |
| 3,144,375 | 8/1964 | Day | 428/18 |
| 4,068,482 | 1/1978 | Hilfiker | 405/272 |
| 4,834,585 | 5/1989 | Hasenwinkle et al. | 52/233 X |
| 5,085,900 | 2/1992 | Hamlett | 428/18 |

*Primary Examiner*—Henry F. Epstein
*Attorney, Agent, or Firm*—Richard C. Litman

[57] ABSTRACT

An artificial tree suitable for interior or exterior use capable of being formed in a variety of possible configurations simulative of a natural palm tree. The artificial tree has a body consisting of a trunk with one or more branch segments joined thereto, a plurality of leaf assemblies joined to the upper end of each branch segment, and a base for retaining ballast material capable of supporting the tree in a generally upright orientation. To enhance the appearance and stability of the tree, triangularly shaped trunk support members may be attached to the lower end of the trunk. Similarly, simulative decaying fronds joined to the upper end of each branch segment enhance appearance. Leaf assemblies having nested leaves of metallic sheet material provide shade. The base, having attached seat members, permits users to sit comfortably beneath the shade provided by the instant tree.

18 Claims, 3 Drawing Sheets

ARTIFICIAL TREE

This application is a continuation in part of application Ser. No. 07/761,628 filed Sep. 18, 1991 now U.S. Pat. No. Des. 343,318.

FIELD OF THE INVENTION

The present invention relates to artificial trees and, in particular, to those simulating natural palm trees for ornamental and display purposes.

BACKGROUND OF THE INVENTION

The benefits of artificial trees over their natural counterparts are well known. Artificial trees require little maintenance. Such trees need not be watered, pruned, or sprayed with insecticide to remove unwanted pests. Furthermore, they shed no leaves, are green year-round, and provide desirable shade from the hot sun. Additionally, artificial trees bearing a resemblance to exotic species, such as palms, provide their high latitude owners with the ongoing and pleasant illusion of life in warmer climes. Unfortunately, most artificial trees available in the marketplace of today presenting a palm-like appearance suffer from their inability to withstand the effects of long-term exposure to the elements. A need, therefore, exists for a weather resistant artificial palm tree.

DESCRIPTION OF THE RELATED ART

Attempts have been made in the past to create palm tree lookalikes. U.S. Pat. No. 2,080,523, issued May 18, 1937 to R. Williams et el, discloses an artificial palm tree with a trunk comprised of a plurality of stacked, circular, cork disks. The disks each have an aperture extending centrally therethrough, and through which a flexible wire rod is inserted to assemble the tree. As the tree shape may be modified with a bend or twist of the hand, relatively modest winds would seemingly drive such a tree to the ground. Additionally, U.S. Pat. Nos. 2,251,705 and 2,251,706, issued on Aug. 5, 1941 to R. A. Gonzalez and R. Loewy respectively, each provide artificial palm trees including means for circulating a chilling medium therethrough, whereby the exterior surface of the tree may be chilled. The refrigeration apparatus provided by such devices would be of little utility when such trees are erected out of doors.

None of the above inventions and patents, taken either singly or in combination, is seen to describe the instant invention as claimed.

SUMMARY OF THE INVENTION

According to the present invention there is provided an artificial palm tree of strong, weather-resistant construction. The present invention is an improvement in that it is uncomplicated and is not required to be used in combination with additional, elaborate structures such as those disclosed in the prior art.

It is, therefore, a principal object of the invention to provide a weather-resistant artificial tree in which the trunk or body portions thereof are capable of being joined to form a rigid structural framework in a variety of possible configurations to closely simulate those of natural palm trees.

It is another object of the invention to provide an artificial tree wherein the trunk or body portion thereof comprises a plurality of wooden landscape timbers to which removable leaf assemblies, simulating the natural leaves or fronds of a palm tree, may be mounted upon the uppermost portion thereof.

It is a further object of the invention to provide an artificial tree for interior or exterior use and having a supporting base of suitable dimensions to provide a bench or seat, above the ground surface, for those relaxing adjacent to the tree.

Still another object of the invention is to provide an artificial tree which is simple in construction, easily and readily assembled, manufactured at comparatively little cost and adapted to have a wide range of uses.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
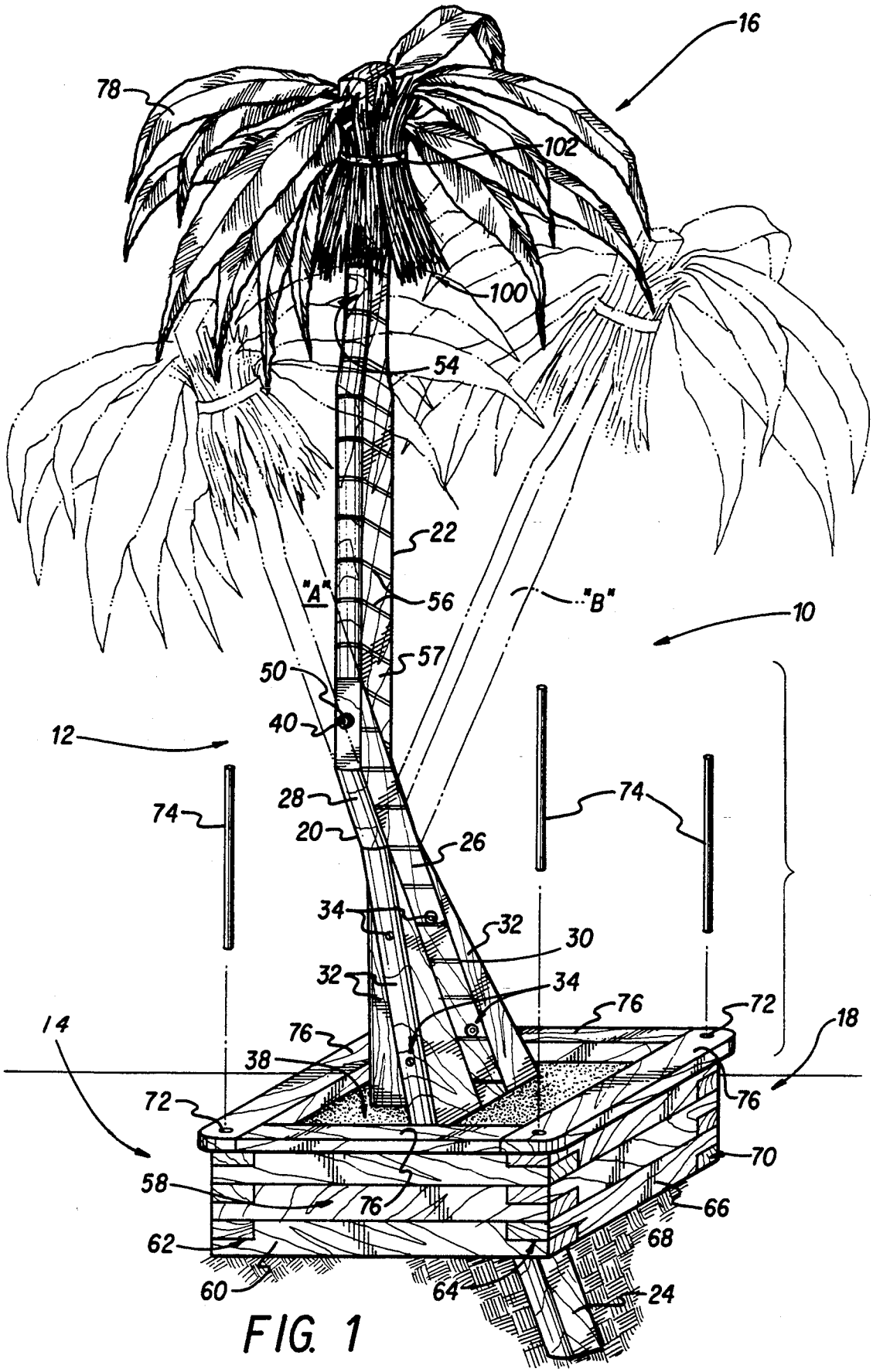
FIG. 1 is perspective view of an artificial tree in accordance with this invention. Two suggested positions for the attachment of additional branch segments are shown in broken lines.

Referring now to the embodiment of the invention shown in the figures by way of example only, FIG. 1 shows the preferred embodiment of an artificial tree 10. Tree 10 may be divided into three primary components for purposes of description: a body 12, a substantially rectangular container or base 14, and a crown 16. When utilized out of doors, the lower end of body 12 is fixedly positioned beneath ground surface 18, thereby retaining tree 10 in an upright position as shown.

Body 12 consists of a lower portion or trunk 20 simulating the principal woody axis of a palm tree and an upper portion or branch segment 22 simulating a secondary woody stem or limb growing from trunk 20. Rectangular base 14 surrounds trunk 20 which extends upwardly therefrom to any desired height. To permit trunk 20 to be arranged at various angles relative to the ground surface, a hole having sloping walls may be excavated in the earth and the lower end of trunk 20 placed therein. Insertion of trunk 20 into this hole will cause the same to extend upwardly at an angle from vertical in a manner similar to that of some natural palm trees. To prevent the rotting of trunk material when such is retained within the ground for extended periods, as is expected of the instant tree, the buried portion may be treated with pitch, tar, or other well known waterproof coatings as at 24.

In the preferred embodiment, trunk 20 consists of a dressed, wooden, landscape timber or any like, rigid material. Landscape timbers, having two opposing and substantially flat surfaces, as well as two opposing convex surfaces, may be readily obtained in today's marketplace and are utilized in the construction of the instant inventive tree. Although trunk 20 may be provided with any cross-sectional configuration simply by shaving or removing material therefrom, the preferred embodiment utilizes a landscape timber, such as has been described, having a substantially unmodified cross section. For this reason, trunk may be seen in FIGS. 1 and 2 to have flat, 26, and convex, 28, surfaces. Trunk 20, however, may be provided with a realistic and life-like appearance by the application of decorative and recessed grooves, as at 30, simulative of the bark of a palm tree. Joined to the lower end of trunk 20 are trunk support members 32. Members 32, comprised of wood, fiberglass, or plastic are substantially triangular in shape and have an attaching surface 34, seen in FIG. 2, adapted to be fitted in flush fashion against trunk 20. In this regard, members 32 fitted against flat surfaces 26 of trunk 20 will have a flat surface while members 32 joined to the convex surfaces 28 of trunk 20 will have concave surfaces. Members 32 are joined, in the preferred embodiment, to trunk 20 by threaded fasteners 34, however, it is anticipated that any fastening means may be utilized for this purpose including adhesive cements. In addition to simulating the appearance of a flared, lower end of a natural palm trunk, members 32 each have a flat bottom surface 36 which may be placed upon or within ballast material 38 to provide additional lateral stability to tree 10 by distributing wind and gravitational loads to ballast 38. The preferred embodiment of tree 10 is provided with three support members 32. Nonetheless, a fewer or greater number may be provided, their placement being determined by the particular application.

One or more branch segments 22 may be fastened to trunk 20. In the preferred embodiment, however, only one branch segment 22 is shown attached to trunk 20 which has a flat attachment surface 53, seen in FIG. 2, at its upper end to provide a secure fit of the respective components. Fastener 40, having a threaded pin 42 with a head 44 at one end and adapted to be inserted through corresponding holes 46 and 48 in trunk 20 and branch segment 22, and a mated nut 50 adapted to fit upon threaded pin 42 for securing fastener 40 when tightened by the application of torque, joins trunk 20 and branch segment 22. Additional branch segments, whose positions are indicated by broken lines in FIG. 1, may be joined to trunk 20 in a manner similar to that previously described. Alternatively, branch segment 22 may be joined to trunk 20 at the indicated positions thereby providing a tree with a substantially straight trunk, as at position "A", or a greatly angled trunk, as at position "B".

Branch segment 22 is constructed of materials similar to those utilized in trunk 20, e.g., dressed, wooden, landscape timbers or like rigid materials. Further, branch segment 22 may be provided with any cross-sectional configuration simply by shaving or removing material therefrom in manner similar to that described for shaping trunk 20. The preferred embodiment utilizes a landscape timber having a somewhat modified cross section. For this reason, branch segment 22 may be seen in FIGS. 1 and 2 as having flat surfaces 52 in addition to shaved, or narrowed, convex surfaces 54 to simulate the irregular cross section presented by the uppermost portion of a natural palm tree. Additionally, branch segment 22 is provided with decorative and recessed grooves, as at 56, simulative of the bark of a palm tree to further enhance the appearance of tree 10.

Base 14 includes four substantially vertical walls, as at 58, adapted to retain ballast material 38. This ballast material 38, poured into the space enclosed by walls 58 assists in retaining tree 10 in an upright orientation and may consist of loose aggregate materials such as: sand, gravel, or crushed oyster shells, or rigid materials such as: cured concrete or cement. For interior display, the lower end of trunk 20 need not be anchored to a floor. Ballast 38 alone is sufficient to retain tree 10 in an upright orientation, and tree 10 need not be anchored to any other structure.

Walls 58 may be readily disassembled and transported from site to site and include a plurality of first horizontally positioned preformed timbers or blocks, as at 60, having a generally rectangular solid form as well as upper and lower surfaces defining height, two oppositely positioned surfaces defining width, and two opposing end surfaces defining length. Each block 60 further includes two lateral rabbets, as at 62 and 64, extending across its upper surface at opposing ends of the block. Rabbets 62 and 64 have a depth substantially equivalent to one half of the height of block 60. Walls 58 also include a plurality of second horizontally positioned preformed timbers or blocks, as at 66, each having a generally rectangular solid form as well as upper and lower surfaces defining height, two oppositely positioned surfaces defining width, and two opposing end surfaces defining length. Each block 66 further includes two lateral rabbets, as at 68 and 70, extending across its lower surface at opposing ends of the block. Rabbets 68 and 70 have a depth substantially equivalent to one half of the height of block 66.

To assemble base 14, corresponding rabbets in two first blocks 60 and two second blocks 68 are aligned to form the corners of a rectangle. Holes 72 provided in the center of each rabbet permit the insertion of locking rods or tubes 74 of similar diameter thereby retaining the blocks in the desired rectangular orientation. By fitting additional numbers of second and first blocks respectively upon tubes 74, sturdy walls 58 may be constructed to a height substantially equal to that of tubes 74. Since tubes 74, constructed of PVC pipe in the preferred embodiment, are easily cut to any length, the height of base 14 may be easily adjusted to suit the particular requirements of any setting where tree 10 may be erected.

Joined to the top of vertical walls 58 are four horizontal seat members 76. Seat members 76 form a bench upon which individuals may sit and enjoy the shade provided by tree 10. In the preferred embodiment, seat members 76 consist of wooden boards, however, it is envisioned that seat members 76 may be padded or provided with cushions to provide a more comfortable seat.

Figure 2:
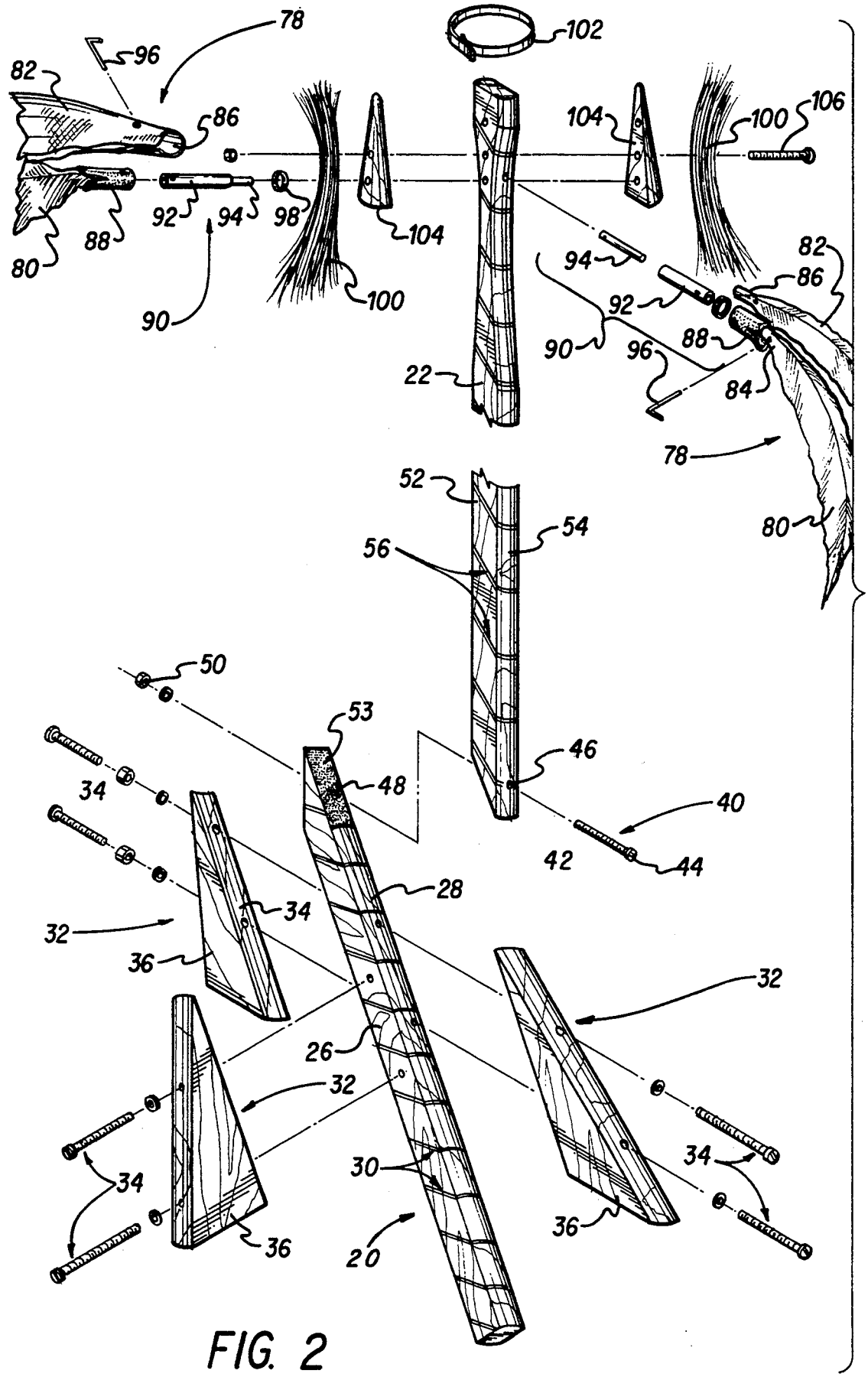
FIG. 2 is an exploded, perspective view of an artificial tree, base removed, showing details thereof.
Figure 3:
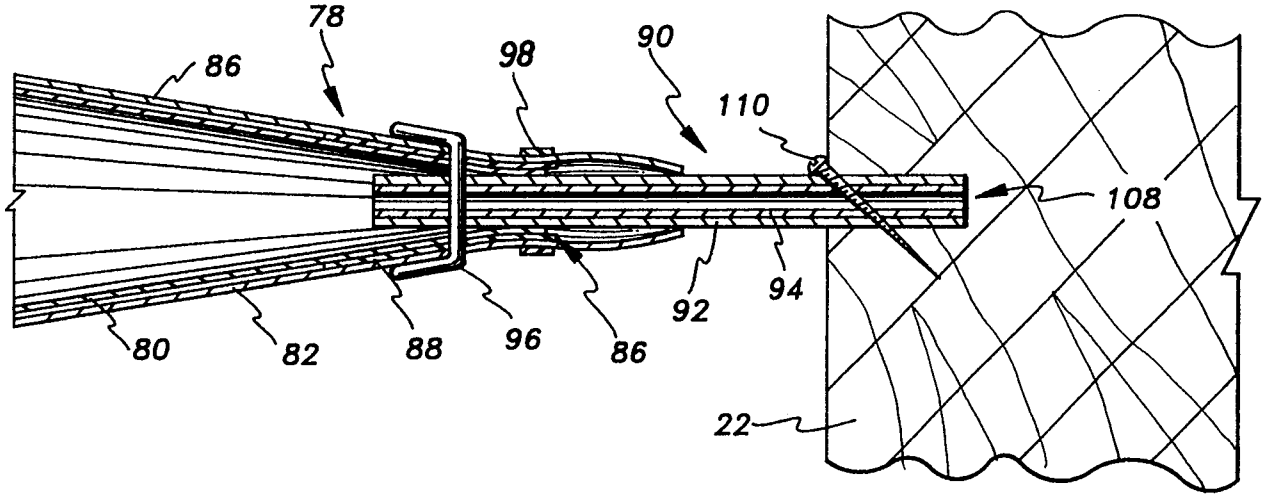
FIG. 3 is a cross sectional view of a leaf assembly, enlarged to show detail and partially broken away, mounted upon the upper end of a branch segment.

To provide shade, joined to the upper end or crown 16 of branch segment 22 are a plurality of leaf assemblies, as at 78. Referring now to FIGS. 2 and 3, the internal structure of a representative leaf assembly may be clearly seen. Leaf assembly 78 consists of two nested leaves, interior leaf 80, and exterior leaf 82. Leaves 80 and 82 are fabricated from metallic sheet material cut and shaped to simulate the configuration of a natural palm leaf. Additionally, leaves 80 and 82 are each provided with a conical stem end, 84 and 86 respectively. The conical stem end of each inner leaf 84 is adapted to be tightly fitted within the conical stem end of a corresponding exterior leaf 86. A flexible separator tube 88 is positioned upon the conical stem end of the inner leaf 84 before such is inserted within exterior leaf 86 to provide a secure fit between the respective components and reduce the intensity of any noise which may occur as a result of forces exerted by strong wind gusts moving the metallic parts of leaf assembly 78 relative to one another. Within conical stem ends 84 and 86, a rigid stem 90 is partially inserted to simulate the natural stem of a palm leaf as well as provide a means for attachment of leaf assembly 78 to branch segment 22. In the preferred embodiment, stem 90 consists of two nested PVC tubes 92 and 94, the former having an inner diameter slightly larger than the outer diameter of the latter thereby permitting the two tubes to be fitted together as a single unit. The two nested tubes 92 and 94, being of similar length, provide a stem of sufficient strength to withstand the strongest natural wind gusts. It is envisioned, however, that construction of stem 90 may be accomplished by utilizing one of many other materials appropriate dimensions and strength including: metal, wood, or plastic. Materials of lesser strength, such as rolled paper cardboard, would be relegated to interior use only. Retaining leaf assembly 78 as a unit is metallic fastening pin 96 inserted through corresponding holes provided in leaves 80 and 82, separator tube 88, and stem 90. Although bending the opposite ends of pin 96 locks the leaf assembly components together, the components may still move relative to each other under wind loads and, for this reason, a flexible and elastic support ring 98 is fitted about the conical stem end of exterior leaf 82 to provide leaf assembly 78 with additional support. Although the preferred leaf assembly 78 consists of one interior and one exterior leaf, leaf assemblies may be constructed with additional interior leaves. By adding interior leaves, a palm tree with lush growth, and capable of providing a significant amount of shade, may be simulated.

As a natural palm tree grows upward from the ground surface, dead leaves or fronds do not immediately detach from the tree but droop or sag below new growth emerging at the top of the tree. To simulate these decaying palm fronds, straw, natural hemp fibers, or similar materials may be joined to the distal or upper end of branch segment 78 as is shown at 100. Joining of simulative fronds 100 and branch segment 22 may be accomplished with adhesives well known in the art. Also, mechanical means, such as strap 102, may be utilized for this purpose. As the dead and decaying fronds seldom lay flat against the body of the tree but, rather, project slightly outward at their bottom, branch segment 22 is provided with conically shaped frond support members 104 at its distal or upper end. Frond support members 104 may be joined to branch segment 22 with adhesives or threaded fasteners 106.

Figure 4:
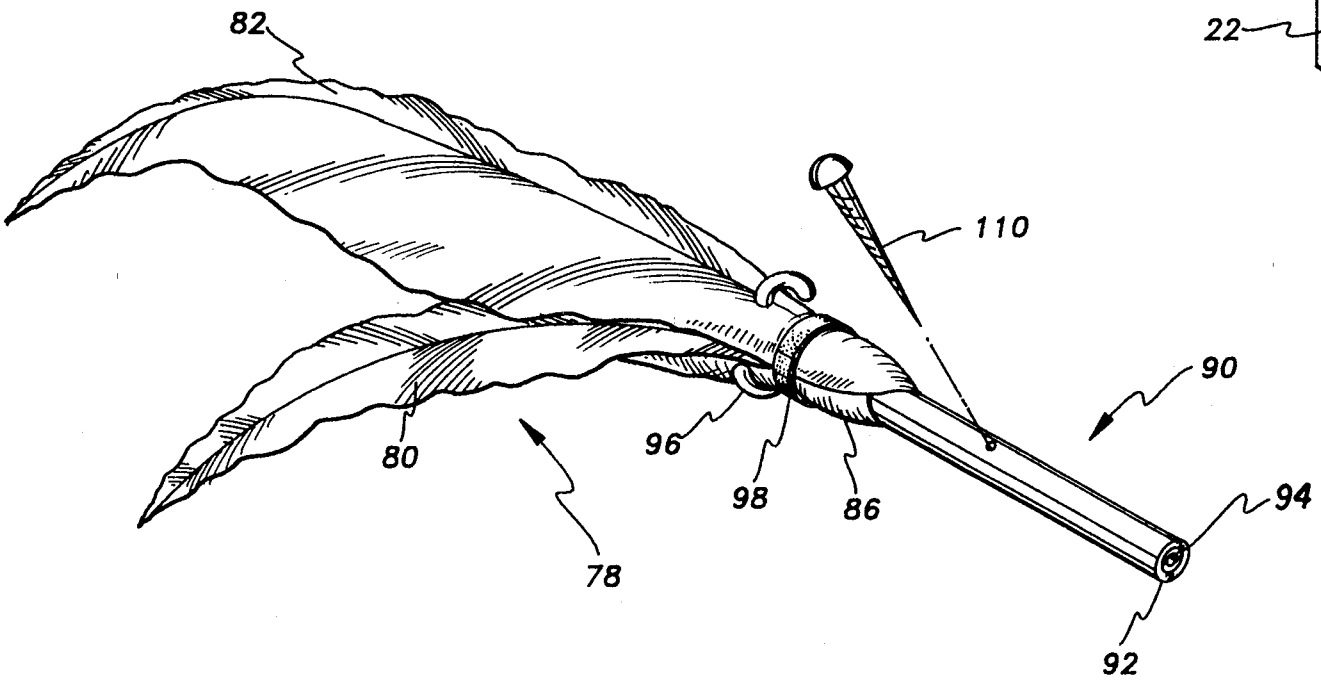
FIG. 4 is a perspective view of a leaf assembly.

Referring now to FIGS. 3 and 4, the means for attaching leaf assembly 78 to branch segment 22 may be viewed. Shallow bore 108 is provided within the distal ends of branch segment 22 and frond support members 104 of a diameter sufficient to accommodate each stem 90. Bore 108 need not be perpendicular to the surface of the tree's body. In fact, bores with various slopes relative to the surface of the tree aid in providing a realistic appearance to tree 10. Threaded fasteners, such as screws 110, driven through stem 90 and into branch segment 22 retain leaf assembly 78 in place.

It is to be understood that the present invention is not limited to the sole embodiment described above, but encompasses any and all embodiments within the scope of the following claims.

I claim:

1. An artificial tree for interior or exterior use, comprising:
- a base;
- a body extending upwardly from said base including:
  - a rigid trunk and at least one branch segment;
  - means for fastening said trunk and said at least one branch segment together;
- a plurality of leaf assemblies mounted on the upper end of said at least one branch segment;
- said means for fastening said trunk and said at least one branch segment together comprises:
  - a fastener having a threaded pin with a head at one end, adapted to be inserted through opposing holes in said trunk and said at least one branch segment; and
  - a mated nut adapted to fit upon said threaded pin for securing said fastener when tightened by application of torque.

2. The artificial tree according to claim 1, wherein said base includes:
- a plurality of substantially vertical walls adapted to retain ballast material; and
- a plurality of horizontal seat members joined to the top of said vertical walls.

3. The artificial tree according to claim 2, wherein said vertical walls include:
- a plurality of first horizontally positioned preformed blocks, said first blocks having a generally rectangular solid form as well as upper and lower surfaces defining height, two oppositely positioned surfaces defining width, and two opposing end surfaces defining length, each said first block further including:
  - two lateral rabbets extending across said upper surface and at opposing ends of each said first block, each said rabbet having a depth substantially equivalent to one half of the height of each said first block; and
- a plurality of second horizontally positioned preformed blocks, said second blocks having a generally rectangular solid form as well as upper and lower surfaces defining height, two oppositely positioned surfaces defining width, and two opposing end surfaces defining length, each said second block further including:
  - two lateral rabbets extending across said lower surface and at opposing ends of each said second block, each said rabbet having a depth substantially equivalent to one half of the height of each said second block.

4. The artificial tree according to claim 1, wherein said body further comprises:
- a waterproof coating.

5. The artificial tree according to claim 1, wherein said body further comprises:
- a plurality of trunk support members joined to the lower end of said trunk.

6. The artificial tree according to claim 1, further comprising:
- a plurality of fronds simulative of natural decaying palm leaves; and
- a plurality of frond support members joined to the upper end of each said branch segment.

7. The artificial tree according to claim 1, wherein said trunk and said branch segment comprise:
- rigid, dressed pieces of wood including decorative grooves.

8. The artificial tree according to claim 1, wherein each said leaf assembly comprises:
- a plurality of nested leaves including at least one interior leaf and one exterior leaf, each of said leaves constructed of metallic sheet material formed to simulate a natural palm leaf and having a conical stem end;

one or more flexible separator tubes corresponding in number to that of said interior leaves, each said tube positioned upon said conical stem end of each said interior leaf;

a rigid stem positioned within the conical stem ends of each said nested leaf;

a fastening pin inserted through each said leaf, each said separator tube, and said stem

9. An artificial tree for interior or exterior use, comprising:

a body having a rigid trunk and at least one rigid branch segment;

means for fastening said trunk and said at least one branch segment together;

a plurality of leaf assemblies mounted on the upper end of said at least one branch segment;

said means for fastening said trunk and said at least one branch segment together comprises:

a fastener having a threaded pin with a head at one end, adapted to be inserted through opposing holes in said trunk and said at least one branch segment; and a mated nut adapted to be fit upon said threaded pin for securing said fastener when tightened by application of torque.

10. The artificial tree according to claim 9, wherein said body further comprises:

a waterproof coating.

11. The artificial tree according to claim 9, wherein said body further comprises:

a plurality of trunk support members joined to the lower end of said trunk.

12. The artificial tree according to claim 9, further comprising:

a plurality of fronds simulative of natural decaying palm leaves; and a plurality of frond support members joined to the upper end of each said branch segment.

13. The artificial tree according to claim 12, wherein said fronds are comprised of natural hemp fibers.

14. The artificial tree according to claim 9, wherein said trunk and said branch segment comprise:

dressed pieces of wood including decorative grooves.

15. The artificial tree according to claim 9, wherein each said leaf assembly comprises:

a plurality of nested leaves, said leaves including at least one interior leaf and one exterior leaf, each of said leaves constructed of metallic sheet material and formed to simulate a natural palm leaf having a conical stem end;

one or more flexible separator tubes corresponding in number to that of said interior leaves, each said tube positioned upon said conical stem end of each said interior leaf;

a rigid stem positioned within the conical stem ends of each said nested leaf;

a fastening pin inserted through each said leaf, each said separator tube, and said stem.

16. The artificial tree according to claim 15, wherein each said leaf assembly further includes:

a flexible and elastic support ring fitted about said conical stem end of said exterior leaf.

17. An artificial leaf assembly, comprising:

at least one interior leaf and one exterior leaf, each of said leaves constructed of metallic sheet material and formed to simulate a natural palm leaf having a conical stem end;

one or more flexible separator tubes corresponding in number to that of said interior leaves, each said tube positioned upon said conical stem end of each said interior leaf;

a rigid stem positioned within the conical stem ends of each said nested leaf;

a fastening pin inserted through each said leaf, each said separator tube, and said stem.

18. The artificial leaf assembly according to claim 17, further including:

a flexible and elastic support ring fitted about said conical stem end of said exterior leaf.

* * * * *